US007319186B2

(12) United States Patent
Kawashima

(10) Patent No.: US 7,319,186 B2
(45) Date of Patent: Jan. 15, 2008

(54) SCRAMBLING METHOD OF MUSIC SEQUENCE DATA FOR INCOMPATIBLE SOUND GENERATOR

(75) Inventor: Takahiro Kawashima, Hamakita (JP)

(73) Assignee: Yamaha Corporation, Hamamatsu-shi (JP)

( * ) Notice: Subject to any disclaimer, the term of this patent is extended or adjusted under 35 U.S.C. 154(b) by 229 days.

(21) Appl. No.: 11/031,203

(22) Filed: Jan. 7, 2005

(65) Prior Publication Data

US 2006/0027078 A1 Feb. 9, 2006

(30) Foreign Application Priority Data

Aug. 5, 2004 (JP) ..... 2004-229075

(51) Int. Cl.
*G10H 7/00* (2006.01)
*G10H 1/00* (2006.01)

(52) U.S. Cl. ..... 84/609; 84/615; 84/622; 84/645

(58) Field of Classification Search ..... 84/609, 84/622, 645
See application file for complete search history.

(56) References Cited

U.S. PATENT DOCUMENTS 4,336,935 A * 6/1982 Goldfarb ..... 273/460
4,475,429 A * 10/1984 Suzuki ..... 84/622
5,044,251 A * 9/1991 Matsuda et al. ..... 84/615
5,119,710 A * 6/1992 Tsurumi et al. ..... 84/615
5,149,902 A * 9/1992 Washiyama ..... 84/622
5,192,824 A * 3/1993 Shibukawa ..... 84/615
5,554,814 A * 9/1996 Nakata ..... 84/659
5,703,310 A * 12/1997 Kurakake et al. ..... 84/609
5,714,703 A * 2/1998 Wachi et al. ..... 84/603
5,728,961 A * 3/1998 Tamura ..... 84/600
5,731,534 A * 3/1998 Tamura et al. ..... 84/662

(Continued)

FOREIGN PATENT DOCUMENTS

JP 2003-022072 1/2003

OTHER PUBLICATIONS

Yamaha SMAF Global, SMAF Specifications, Yamaha Corporation, internet address http://smaf-yamaha.com/what (Dec. 13, 2004).

*Primary Examiner*—Lincoln Donovan
*Assistant Examiner*—Christina Russell
(74) *Attorney, Agent, or Firm*—Morrison & Foerster LLP

(57) ABSTRACT

A data format of music sequence data represents a music piece and enables a compatible sound generating apparatus to reproduce the music piece at a first quality while allowing a non-compatible sound generating apparatus to reproduce the music piece at a second quality different from the first quality. The music sequence data is composed of event data and timing data. The event data represents various types of musical events occurring during the course of reproducing the music piece. The timing data specifies occurrence timing of each musical event. The event data representing at least one type of the musical events is scrambled such as to affect performance of the non-compatible sound generating apparatus without affecting performance of the compatible sound generating apparatus, so that the compatible sound generating apparatus can maintain the first quality of the music piece even when the music piece is reproduced from the music sequence data containing the scrambled event data, while the non-compatible sound generating apparatus cannot maintain the second quality of the music piece when the music piece is reproduced from the music sequence data containing the scrambled event data.

10 Claims, 7 Drawing Sheets

U.S. PATENT DOCUMENTS 5,831,192 A * 11/1998 Watari et al. ..... 84/600
5,998,722 A * 12/1999 Kondo ..... 84/622
6,025,552 A * 2/2000 Mukaino et al. ..... 84/605
6,137,046 A * 10/2000 Kamiya ..... 84/604
6,154,600 A * 11/2000 Newman et al. ..... 386/4
6,263,313 B1 * 7/2001 Milsted et al. ..... 705/1
6,274,799 B1 * 8/2001 Shimizu ..... 84/622
6,303,852 B1 * 10/2001 Kizaki et al. ..... 84/622
6,343,283 B1 * 1/2002 Saito et al. ..... 705/57
6,392,135 B1 * 5/2002 Kitayama ..... 84/622
6,600,098 B2 * 7/2003 Mizuno et al. ..... 84/622
6,809,248 B2 * 10/2004 Torimura ..... 84/615
6,989,485 B2 * 1/2006 Ochi ..... 84/645
2001/0046298 A1 * 11/2001 Terada et al. ..... 380/252
2002/0046899 A1 * 4/2002 Mizuno et al. ..... 181/142
2002/0189430 A1 * 12/2002 Mukojima ..... 84/615
2003/0177888 A1 * 9/2003 Akahori et al. ..... 84/609
2004/0099126 A1 * 5/2004 Kawashima ..... 84/609
2004/0204062 A1 * 10/2004 Chang ..... 455/556.1
2004/0267541 A1 * 12/2004 Hamalainen et al. ..... 704/278

* cited by examiner

Prior Art

SCRAMBLING METHOD OF MUSIC SEQUENCE DATA FOR INCOMPATIBLE SOUND GENERATOR

BACKGROUND OF THE INVENTION

1. Technical Field

The present invention relates to a data interchange format for interchanging musical sequence data, a sound generating system capable of being mounted on portable terminals such as mobile phones and reproducing a musical file having the data interchange format, and a musical file creation tool capable of creating a musical file having the data interchange format from musical sequence data.

2. Related Art

There are known SMF (Standard MIDI file format) and SMAF (Synthetic Music Mobile Application Format) as data interchange formats for distributing musical sequence data to reproduce musical pieces using a sound generator.

The SMF is a data format for saving musical performance information and interchanging data. When an SMF file is created based on the GM (General MIDI) standard, the file can be reproduced to a certain degree of quality according to a timbre map using musical instrument timbres provided for the sound generator.

The SMAF is a data format specification for representing multimedia contents on mobile terminals (see Online document "SMAF specification outline" by YAMAHA CORPORATION retrieved on Jun. 30, 2004, at the Internet address <URL:http//smaf-yamaha.com/jp/what/smaf_spec.html>).

Further, Patent document, Japanese Patent Unexamined Publication No. 2003-22072, discloses the musical file (SMAF file) with timbre data. For FM sound generators, timbre data (timbre parameters) signifies parameters to specify an FM operation algorithm. For waveform memory (WT) sound generators, timbre data signifies timbre waveform data and the like.

Depending on models of sound generators, the same musical instrument generates different timbre overtones and sound pressures. If an SMF file is created in accordance with the GM timbre map, there may be a case where the musical piece cannot be reproduced as faithfully as producer's intention depending on types and models of sound generators used for the reproduction.

There may be a case of reproducing the musical file (SMAF file) with timbre data as described in the above-mentioned patent document on a sound generator that is incompatible with the timbre data contained in the SMAF file. In this case, the sound generator reproduces equivalent timbres using its own timbre data while ignoring the timbre data attached to the file. Likewise the case of SMF files, the sound generator reproduces the file using its own default timbres corresponding to program change numbers (timbre numbers) included in program change messages.

Presently, some portable terminals use sound generators incompatible with the timbre data contained in the SMAF file. Other portable terminals use sound generators compatible with the timbre data contained in the SMAF file.

FIG. 8 shows a manner by which a general sound generator, SMAF-incompatible sound generating system, reproduces a music content of SMAF file containing timbre data.

According to the example shown in FIG. 8, the content is an SMAF file containing a specific piano timbre corresponding to program change number #1 and a specific guitar timbre corresponding to program change number #25. When processing this SMAF file, the SMAF-incompatible sound generating system cannot process the attached timbres. The system reproduces equivalent or substitute timbres such as general piano timbre and general guitar timbre stored in the system ROM based only on the program change numbers.

Regarding the piano corresponding to program change number #1, for example, the SMAF file originally contains the timbre data representing the specific piano timbre tuned to the musical piece's atmosphere. It is not proper to use any generic piano timbres in place of the specific piano timbre tuned to the musical piece's atmosphere. Nevertheless, the SMAF-incompatible sound generating system generates substitute timbres. Accordingly, the timber reproduced by the SMAF-incompatible sound generator becomes different from the original timbre that the producer has intended.

Nevertheless, a user still listens to nothing but the reproduced piano sound and may not notice a delicate difference from the original piano sound. The user misunderstands the grade of the musical file, degrading its true value.

SUMMARY OF THE INVENTION

It is an object of the present invention to provide a data interchange format (hereinafter, occasionally referred to as "data format" for simplicity) capable of ensuring reproduction of musical pieces as intended by a producer and capable of interchanging musical sequence data, a sound generating system capable of reproducing a musical file having the data interchange format, and a musical file creation tool capable of creating a musical file having the data interchange format.

In order to achieve the above-mentioned object, according to one aspect of the invention, there is provided a data format of music sequence data which represents a music piece and which enables a compatible sound generating apparatus to reproduce the music piece at a first quality while allowing a non-compatible sound generating apparatus to reproduce the music piece at a second quality different from the first quality. The music sequence data comprises: event data that represents various types of musical events occurring during the course of reproducing the music piece; and timing data that specifies occurrence timing of each musical event. Characterizingly, the event data representing at least one type of the musical events is scrambled such as to affect performance of the non-compatible sound generating apparatus without affecting performance of the compatible sound generating apparatus, so that the compatible sound generating apparatus can maintain the first quality of the music piece even when the music piece is reproduced from the music sequence data containing the scrambled event data, while the non-compatible sound generating apparatus cannot maintain the second quality of the music piece when the music piece is reproduced from the music sequence data containing the scrambled event data.

Preferably, the inventive data format further comprises timbre data which represents a set of timbres applicable to sounds of the music piece and identified by program change numbers, wherein said one type of the musical events are program change events which contain the program change numbers for specifying the timbres, and wherein the program change numbers are scrambled such that the non-compatible sound generating apparatus cannot apply equivalent timbres corresponding to the specified timbres in response to the program change events thereby failing to maintain the second quality, while the compatible sound generating apparatus can properly apply the specified timbres in response to the program change events thereby maintaining the first quality.

Preferably, the inventive data format further comprises channel attribute information which defines correspondence between channel numbers and kinds of timbres allocated to notes of the music piece, wherein said one type of the musical events are note events which determine the notes occurring during the course of reproducing the music piece and which contain the channel numbers specifying the kinds of the timbres allocated to the notes, and wherein the channel numbers are scrambled such that the non-compatible sound generating apparatus cannot allocate the specified kinds of the timbres to the notes in response to the note events thereby failing to maintain the second quality, while the compatible sound generating apparatus can allocate the specified kinds of the timbres to the notes properly based on the channel attribute information in response to the note events thereby maintaining the first quality.

Preferably, the inventive data format further comprises scramble information which can be interpreted by the compatible sound generating apparatus for restoring the scrambled event data and which cannot be interpreted by the non-compatible sound generating apparatus, whereby the compatible sound generating apparatus can restore the scrambled event data based on the scramble information so as to reproduce the music piece at the first quality, while the non-compatible sound generating apparatus cannot restore the scrambled event data thereby failing to maintain the second quality of the music piece.

Typically, said one type of the musical events are note events which determine notes occurring during the course of reproducing the music piece and which contain note numbers specifying pitches of the notes, and wherein the note numbers are scrambled so that the non-compatible sound generating apparatus cannot reproduce the notes of the music piece at the specified pitches, thereby failing to maintain the second quality.

Practically, the event data representing two or more types of the musical events are scrambled such as to affect performance of the non-compatible sound generating apparatus.

In another aspect of the invention, there is provided a sound generating apparatus comprising: an input section that receives a musical file which contains music sequence data representing a music piece and also contains timbre data representing a set of timbres applicable to sounds of the music piece and identified by program change numbers, the music sequence data comprising event data and timing data, the event data representing program change events which occur during the course of reproducing the music piece and which contain the program change numbers for specifying the timbres, the program change numbers being previously scrambled, the timing data specifying occurrence timing of each program change event; a storage section that stores the timbre data which is contained in the inputted musical file and which represents the set of the timbres in correspondence to the scrambled program change numbers; and a generating section that generates the sounds of the music piece according to the music sequence data such that the specified timbres are properly applied to the generated sounds from the stored set of the timbres in response to the program change events even though the program change numbers are previously scrambled.

In still another aspect of the invention, there is provided a sound generating apparatus comprising: an input section that receives a musical file which contains music sequence data representing a music piece and also contains channel attribute information which defines correspondence between channel numbers and kinds of timbres allocated to notes of the music piece, the music sequence data comprising event data and timing data, the event data representing note events which determine the notes occurring during the course of reproducing the music piece and which contain the channel numbers specifying the kinds of the timbres allocated to the notes, the channel numbers previously being scrambled, the timing data specifying occurrence timing of each program change event; a setup section that sets the correspondence between the scrambled channel numbers and the kind of the timbres based on the channel attribute information contained in the inputted musical file; and a generating section that generates the notes of the music piece according to the music sequence data contained in the inputted musical file such that the specified kinds of the timbres are properly allocated to the notes in response to the scrambled channel numbers contained in the note events.

In a further aspect of the invention, there is provided a sound generating apparatus comprising: an input section that receives a musical file which contains scramble information and music sequence data representing a music piece, the music sequence data comprising event data which represents various types of musical events occurring during the course of reproducing the music piece, and timing data which specifies occurrence timing of each musical event, the event data which represents at least one type of the musical events being scrambled, the scramble information being used for restoring the scrambled event data; a restoring section that interprets the scramble information contained in the inputted musical file and that restores the scrambled event data according to the interpreted scramble information; and a generating section that generates sounds of the music piece according to the music sequence data containing the restored event data. Preferably, said one type of the musical events are program change events which contain program change numbers for specifying timbres applied to the sounds of the music piece, so that the event data representing the program change numbers are scrambled. Otherwise, said one type of the musical events are note events which determine notes occurring during the course of reproducing the music piece and which contain channel numbers specifying kinds of timbres allocated to the notes, so that the event data representing the channel numbers are scrambled.

In a still further aspect of the invention, there is provided an apparatus for creating a musical file, comprising: an input section that provides music sequence data representing a music piece and having a data format which enables a compatible sound generating apparatus to reproduce the music piece at a first quality while allowing a non-compatible sound generating apparatus to reproduce the music piece at a second quality different from the first quality, the music sequence data comprising event data which represents various types of musical events occurring during the course of reproducing the music piece, and timing data which specifies occurrence timing of each musical event; a scrambling section that scrambles the event data representing at least one type of the musical events such as to affect performance of the non-compatible sound generating apparatus without affecting performance of the compatible sound generating apparatus; and an output section that outputs a musical file of the music sequence data containing the scrambled event data, so that the compatible sound generating apparatus can maintain the first quality of the music piece even when the music piece is reproduced from the outputted musical file, while the non-compatible sound generating apparatus cannot maintain the second quality of the music piece when the music piece is reproduced from the outputted musical file.

Preferably, the scrambling section scrambles the event data representing said one type of the musical events which are program change events containing program change numbers for specifying timbres applicable to sounds of the music piece, and wherein the output section outputs the musical file containing timbre data which represents the timbres specified by the program change numbers, such that the non-compatible sound generating apparatus cannot apply equivalent timbres corresponding to the specified timbres in response to the program change events thereby failing to maintain the second quality, while the compatible sound generating apparatus can properly apply the specified timbres contained in the musical file in response to the program change events thereby maintaining the first quality.

Preferably, the scrambling section scrambles the event data representing said one type of the musical events which are note events determining notes occurring during the course of reproducing the music piece and containing channel numbers specifying kinds of timbres allocated to the notes, and wherein the output section outputs the musical file containing channel attribute information which defines correspondence between the channel numbers and the kinds of the timbres allocated to the notes of the music piece, such that the non-compatible sound generating apparatus cannot allocate the specified kinds of the timbres in response to the note events thereby failing to maintain the second quality, while the compatible sound generating apparatus can allocate the specified kinds of the timbres to the notes properly based on the channel attribute information contained in the musical file thereby maintaining the first quality.

In a still further aspect of the invention, there is provided a computer program for use in creating a musical file. The computer program is executable by a computer to perform a method comprising the steps of: providing music sequence data representing a music piece and having a data format which enables a compatible sound generating apparatus to reproduce the music piece at a first quality while allowing a non-compatible sound generating apparatus to reproduce the music piece at a second quality different from the first quality, the music sequence data comprising event data which represents various types of musical events occurring during the course of reproducing the music piece, and timing data which specifies occurrence timing of each musical event; scrambling the event data representing at least one type of the musical events such as to affect performance of the non-compatible sound generating apparatus without affecting performance of the compatible sound generating apparatus; and creating a musical file of the music sequence data containing the scrambled event data, so that the compatible sound generating apparatus can maintain the first quality of the music piece even when the music piece is reproduced from the created musical file, while the non-compatible sound generating apparatus cannot maintain the second quality of the music piece when the music piece is reproduced from the created musical file.

There may be a non-compatible sound generating system that cannot process a scrambled event as mentioned above. When such sound generating system reproduces a musical file having the data interchange format according to the present invention, an obviously different timbre is reproduced. Namely, the quality of the music piece reproduced by the non-compatible sound generating system is degraded. Thus, the user can be free from the above-mentioned misunderstanding. Namely, the user can realize that the music file is not wrong but the sound generating system is non-compatible to the music file. The user realize that a compatible generating system should be used to evaluate a true grade of the music file.

Accordingly, the data interchange format according to the present invention for interchanging musical sequence data can ensure reproduction of musical pieces according to the producer's intention. It is possible to preserve the value of musical files (contents).

The sound generating system according to the present invention can reproduce musical files having the data interchange format for interchanging the musical sequence data according to the present invention by generating timbres as a producer has intended.

Further, the musical file creation tool according to the present invention can create a musical file having the data interchange format according to the present invention from the musical sequence data.

BRIEF DESCRIPTION OF THE INVENTION

FIGS. 1(*a*) and 1(*b*) are diagrams showing the structure of an musical file having a data interchange format embodied for musical sequence data according to the present invention, wherein FIG. 1(*a*) shows an overall structure of the musical file and FIG. 1(*b*) shows the structure of sequence data contained in a Sequence Data Chunk.

DETAILED DESCRIPTION OF THE INVENTION

Figure 1:
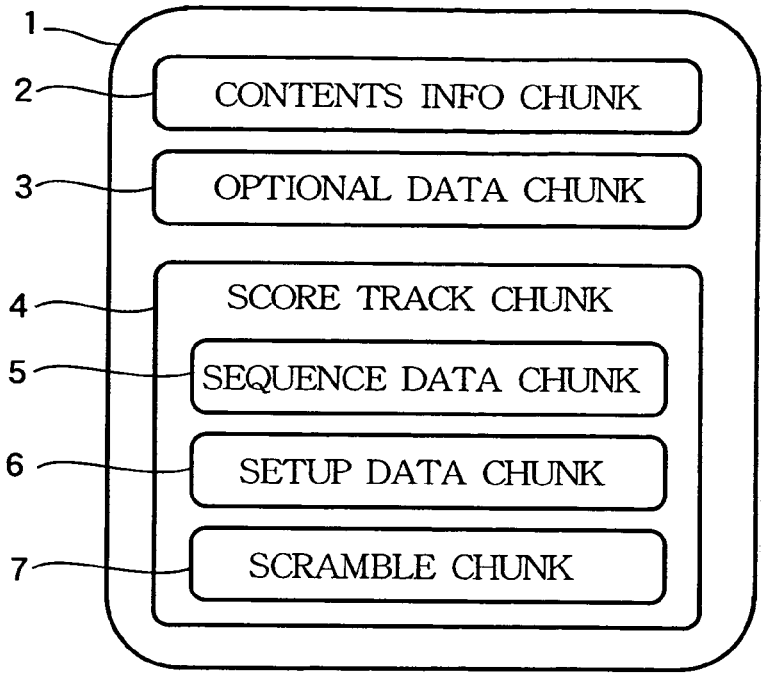
Figure 1:
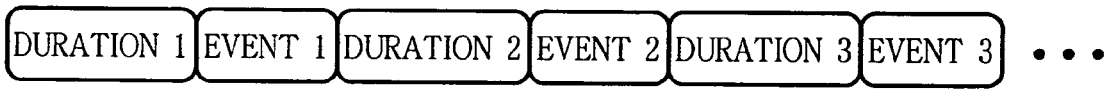

FIG. 1(*a*) shows the file structure of a musical file having a data interchange format according to the present invention.

The musical file has the chunk structure like SMAF files. The reference numeral 1 denotes a musical file's file chunk. The file chunk 1 has a header and a body. The header contains a file ID (chunk ID) to identify the file and a chunk size to indicate the length of the body to follow.

The body comprises a series of chunks. As shown in FIG. 1, the body contains a Contents Info Chunk 2, an Optional Data Chunk 3, and a Score Track Chunk 4.

The Contents Info Chunk 2 stores various management information such as a content type and copy status. The Optional Data Chunk 3 stores a genre name, a song name, an artist name, a songwriter/composer name, and the like.

A Score Track Chunk 4 stores various data for reproducing the sound generator. The Score Track Chunk 4 contains:

a Sequence Data Chunk 5 to store actual musical performance data (sequence data); a Setup Data Chunk 6 to store timbre data and effect setting; and a Scramble Chunk 7 to store scramble information to be described later.

In this manner, the musical file is a modification of an SMAF file. Inclusion of the Scramble Chunk 7 indicates a difference from the ordinary SMAF file. The Scramble Chunk 7 needs not always be contained in the Score Track Chunk 4 and may be disposed elsewhere. An SMAF file may contain a PCM audio track chunk and a graphic trunk chunk that are omitted here, however.

FIG. 1(*b*) shows sequence data contained in the Sequence Data Chunk 5. As shown in this figure, the sequence data comprises sets of an event and a duration in the order of events that occurred. Each duration indicates a lapse of time between events. The event is data representation of the control content for an output device (e.g., the sound generator in this case) defined for the sequence data. For example, like MIDI, events include note messages, program changes, pitch bends, volumes, expressions, and exclusive messages.

The musical file according to the present invention differs from the conventional SMAF file in that, as will be described late, a scramble process is applied to a specific event in the sequence data contained in the Sequence Data Chunk 5.

Figure 2:
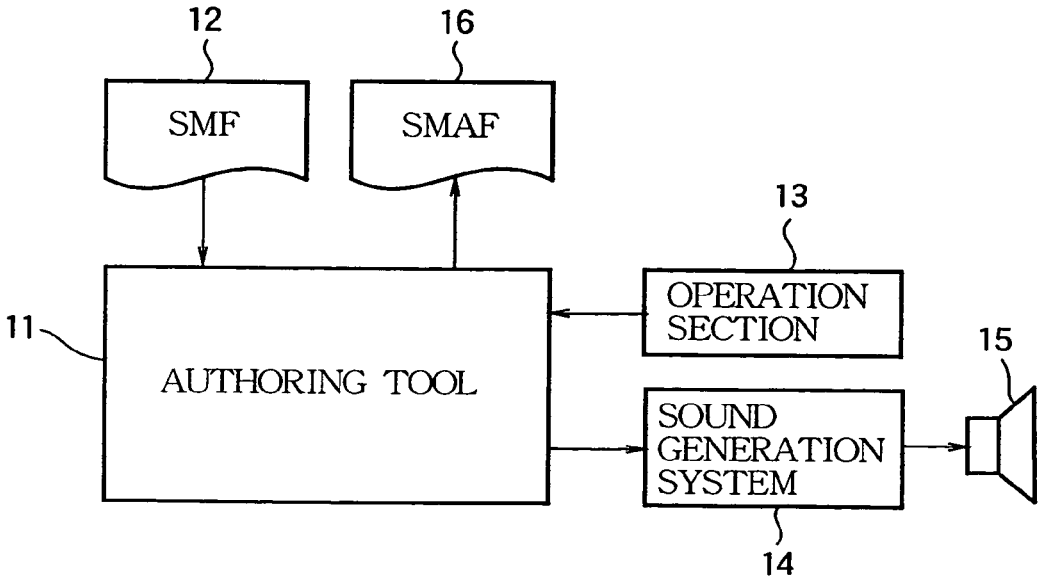
FIG. 2 is a block diagram schematically showing the configuration of a musical file creation tool to create musical files having the data interchange format according to the present invention.

FIG. 2 is a block diagram schematically showing the configuration of a musical file creation apparatus to create musical files having the data interchange format according to the present invention. The musical file creation apparatus creates musical files (SMAF files) according to the present invention using existing sound files (musical piece sequence files) such as SMF and conventional SMAF.

In FIG. 2, the reference numeral 11 denotes a musical file creation tool (authoring tool); 12 denotes an existing sound file such as an SMF file to be input to the authoring tool 11; 13 denotes an operation section to enter various commands and the like; 14 denotes a sound generating system to reproduce SMF files and SMAF files; 15 denotes a speaker; and 16 denotes a musical file (SMAF file) according to the present invention output from the authoring tool 11.

As input, the authoring tool 11 is supplied with the existing sound file (musical sequence data) 12 such as an SMF file (.mid) or a conventional SMAF file (.mmf). The authoring tool 11 applies a scramble process to specific events in the sound file and outputs the musical file (SMAF file) 16 according to the present invention. For example, a computer program implements the authoring tool 11.

Namely, the music file creating apparatus composed of the authoring tool 11 is designed for creating a musical file. In the apparatus, an input section provides music sequence data representing a music piece and having a data format which enables a compatible sound generating apparatus to reproduce the music piece at a first quality while allowing a non-compatible sound generating apparatus to reproduce the music piece at a second quality different from the first quality, the music sequence data comprising event data which represents various types of musical events occurring during the course of reproducing the music piece, and timing data which specifies occurrence timing of each musical event. A scrambling section scrambles the event data representing at least one type of the musical events such as to affect performance of the non-compatible sound generating apparatus without affecting performance of the compatible sound generating apparatus. An output section outputs a musical file of the music sequence data such as SMAF file containing the scrambled event data, so that the compatible sound generating apparatus can maintain the first quality of the music piece even when the music piece is reproduced from the outputted musical file, while the non-compatible sound generating apparatus cannot maintain the second quality of the music piece when the music piece is reproduced from the outputted musical file.

Figure 3:
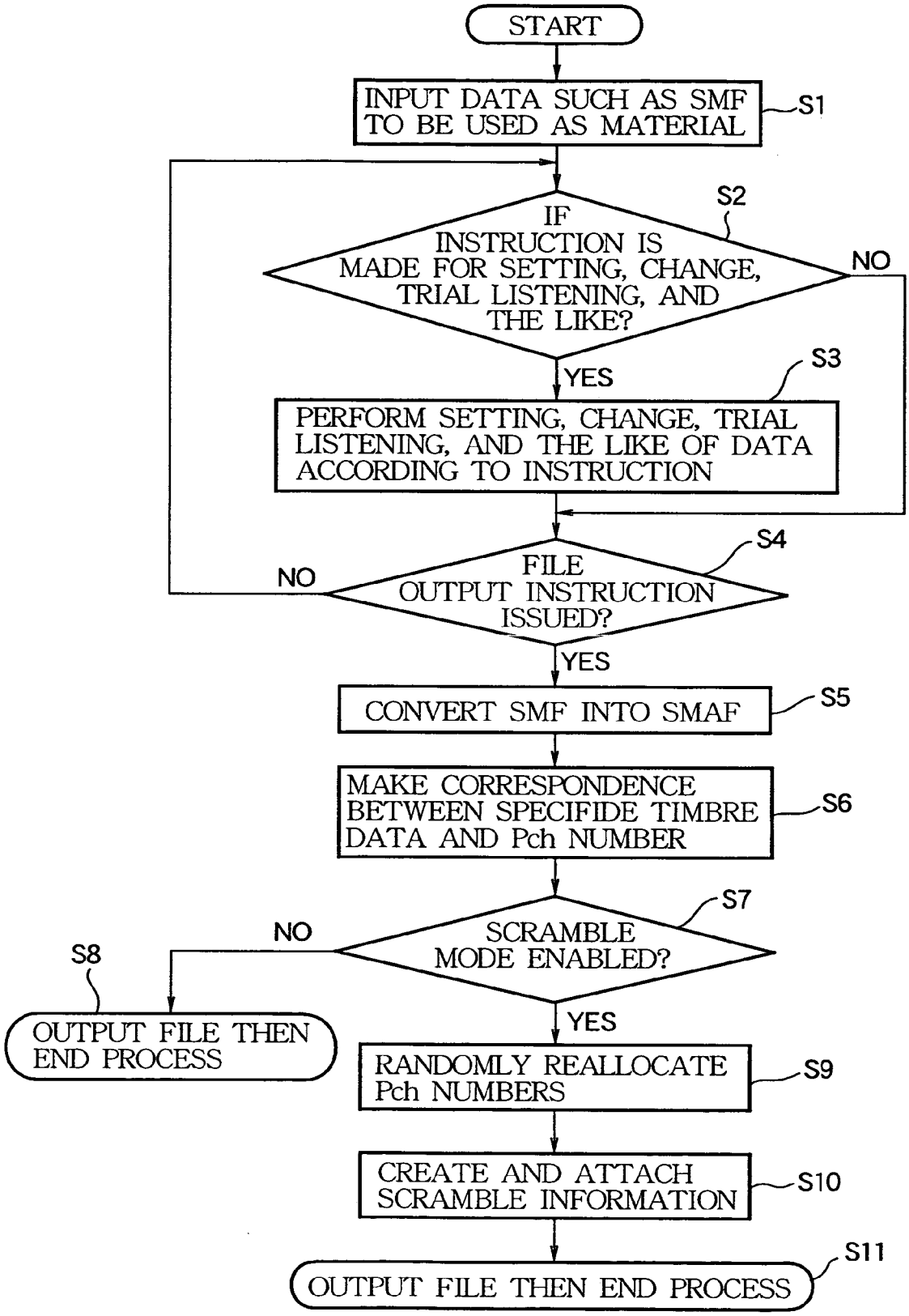
FIG. 3 is a flowchart showing a process flow in the musical file creation tool according to the present invention.

The authoring tool 11 may be composed of a computer program use in creating a musical file. The computer program is executable by a computer to perform a method comprising the steps shown in FIG. 3. FIG. 3 is a flowchart showing a process flow of the authoring tool 11. Basically, the process in FIG. 3 uses the existing sound file as a material to create a new SMAF file. When a scramble mode is enabled, the scramble process is performed for specific events to create a musical file according to the present invention.

Various cases can be considered concerning which event should be scrambled or which algorithm the scramble process should implement. The embodiment applies the scramble process that randomly reallocates program change numbers contained in a program change message so as not to duplicate numbers.

The process is supplied with a sound file (musical sequence data) such as SMF as a material (S1). Based on user's instructions (setting, change, trial listening, and the like) from the operation section 13, the process accordingly makes adjustment such as sound volumes, obtains timbre data, makes correspondence with program change numbers, or enables playback for trial listening (S2, S3). As a result of the trial listening, for example, the ordinary piano timbre may be changed to a specific piano timbre. In such case, the process obtains timbre data for the specific piano timbre and associates it with the corresponding program change number.

When a file output instruction is issued (YES at S4) thereafter, the process converts the sound file into the above-mentioned SMAF file (S5). The process associates the specified timbre data with the program change number to create data for the Setup Data Chunk (S6).

The process determines whether or not the scramble mode is enabled (S7). When the scramble mode is disabled, the process outputs the SMAF file and then terminates (S8).

When the scramble mode is enabled, the process randomly reallocates program change numbers in the program change event contained in the Sequence Data Chunk (S9). At this time, the process also reallocates program change numbers in the timbre data contained in the Setup Data Chunk. The purpose is to change correspondence between the timbre data and the program change number before the reallocation to correspondence between the timbre data and the program change number after the reallocation.

The process creates information (scramble information) used to recover the reallocated program change number. The information is used for the reallocation algorithm and is attached as a Scramble Chunk (S10). In this manner, the process outputs the musical file 16 according to the present invention with scrambled data for the specific event and then terminates (S11).

As mentioned above, the scramble process is provided in the scramble mode and is not provided otherwise. Alternatively, the scramble process may be always provided.

It may be preferable to be able to create SMAF files without defining timbre data. Depending on whether or not timbre data is available, the scramble process may be performed only when the timbre data is contained.

Figure 4:
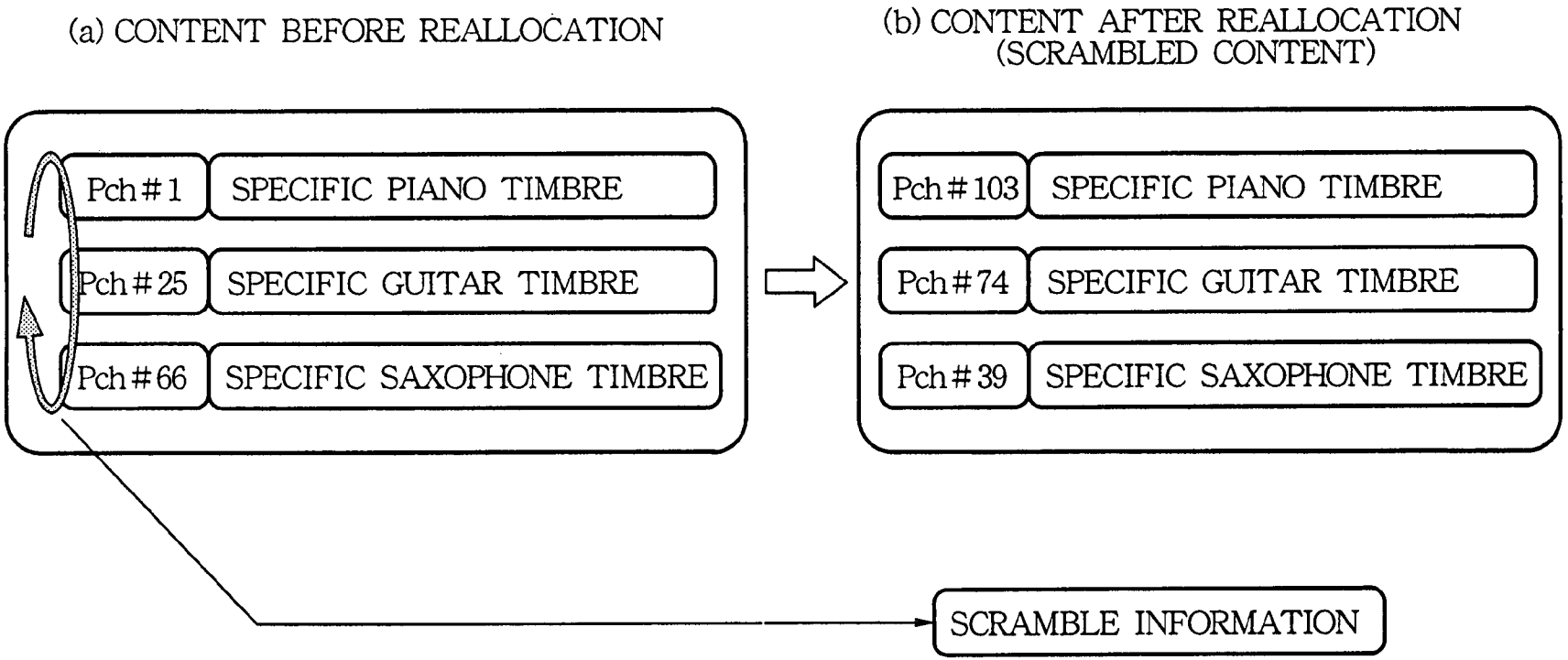
FIG. 4 is a diagram showing an example of the scramble process according to an embodiment of the present invention, wherein a part (a) exemplifies a content before it is scrambled and another part (b) exemplifies a content after it is scrambled.

FIG. 4 shows an example of the scramble process that is performed according to the embodiment. FIG. 4(*a*) shows a content before reallocation. FIG. 4(*b*) shows a content and scramble information after reallocation.

Before reallocation in FIG. 4(*a*), a specific piano timbre corresponds to program change number #1, a specific guitar timbre to #25, and a specific saxophone timbre to #66. The scramble process is then performed to randomly reallocate the program change numbers. As shown in FIG. 4(*b*), the specific piano timbre corresponds to program change number #103, the specific guitar timbre to #74, and the specific saxophone timbre to #39.

The content separately stores the scramble information needed to recover the reallocated program change numbers such as information used for the reallocation process algorithm.

As will be described later, the scramble information is unnecessary for reproduction of the musical file according to the embodiment. Using the scramble information makes it possible to recover the reallocated program change numbers and can facilitate works such as editing scrambled contents.

As described above, the data format of music sequence data represents a music piece and enables a compatible sound generating apparatus to reproduce the music piece at a first quality while allowing a non-compatible sound generating apparatus to reproduce the music piece at a second quality different from the first quality. The music sequence data is composed of event data and timing data. The event data represents various types of musical events occurring during the course of reproducing the music piece. The timing data specifies occurrence timing of each musical event. The event data representing at least one type of the musical events is scrambled such as to affect performance of the non-compatible sound generating apparatus without affecting performance of the compatible sound generating apparatus, so that the compatible sound generating apparatus can maintain the first quality of the music piece even when the music piece is reproduced from the music sequence data containing the scrambled event data, while the non-compatible sound generating apparatus cannot maintain the second quality of the music piece when the music piece is reproduced from the music sequence data containing the scrambled event data.

In detail, the data format further contains timbre data which represents a set of timbres applicable to sounds of the music piece and identified by program change numbers. The afore-mentioned one type of the musical events are program change events which contain the program change numbers for specifying the timbres. The program change numbers are scrambled such that the non-compatible sound generating apparatus cannot apply equivalent timbres corresponding to the specified timbres in response to the program change events thereby failing to maintain the second quality, while the compatible sound generating apparatus can properly apply the specified timbres in response to the program change events thereby maintaining the first quality.

Figure 5:
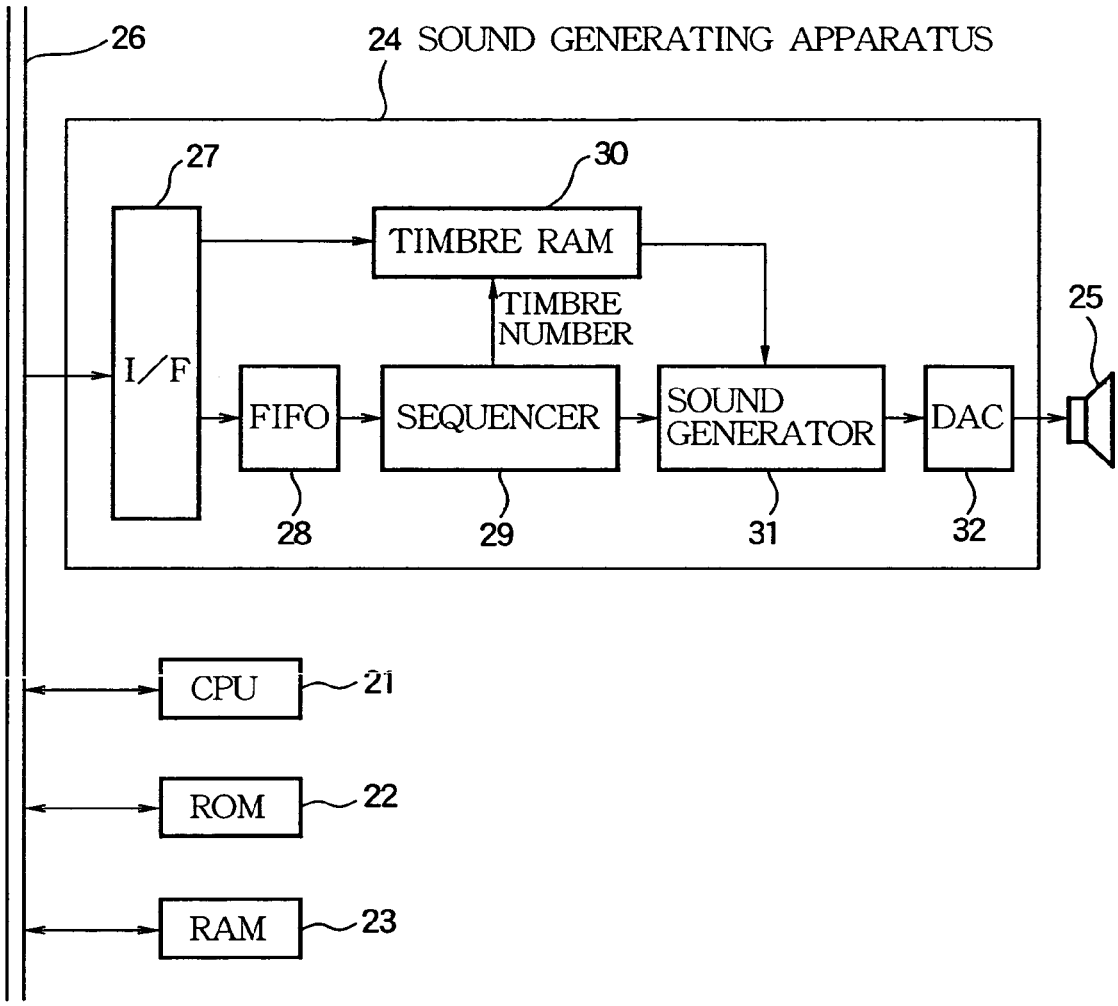
FIG. 5 is a block diagram showing the configuration of a sound generating system capable of reproducing a musical file having the data interchange format according to the present invention.

FIG. 5 is a block diagram showing the configuration of the sound generating system capable of reproducing musical files having the above-mentioned data interchange format according to the present invention.

In FIG. 5, the reference numeral 21 denotes a CPU to control the sound generating system; 22 denotes ROM to store various data such as a control program and preset timbre data; 23 denotes RAM that is used as a work area and stores musical files such as SMAF files to be reproduced and the other data; 24 denotes a sound generating apparatus; 25 denotes a speaker connected to the sound generating apparatus 24; and 26 denotes a bus to connect the constituent components 21 through 24.

As shown in FIG. 5, the sound generating apparatus 24 comprises: an interface circuit 27 connected to the bus 26; a FIFO (first-in first-out) buffer 28 connected to the interface circuit 27; a sequencer 29 connected to the FIFO buffer 28; timbre RAM 30 connected to the interface circuit 27; a sound generating section 31 connected to the sequencer 29 and the timbre RAM 30; and a D/A converter (DAC) 32 to convert a digital sound signal output form the sound generating section 31 into an analog signal.

The sound generating system having the above-mentioned construction may receive an instruction to reproduce SMAF files or musical files having the data interchange format according to the present invention. (It should be noted that these musical files are generically referred to as SMAF files because the musical files can be assumed to be enhanced SMAF files as mentioned above.) In such case, the CPU 21 extracts timbre data contained in the Setup Data Chunk from the SMAF file stored in the RAM 23 and sends the timbre data to the sound generating apparatus 24. The timbre data is written to the timbre RAM 30 via the interface circuit 27.

The CPU 21 then serially transmits sequence data (duration and event) in the SMAF file to the sound generating apparatus 24. The sequence data is transmitted to the sequencer 29 via the interface circuit 27 and the FIFO buffer 28.

The sequencer serially interprets the received sequence data to set sound generator control parameters in the sound generating section 31. In accordance with program change events, the sequencer 29 supplies the program change numbers to the timbre RAM 30. In this manner, the sound generating section 31 is provided with corresponding timbre data from the timbre RAM 30. Since the timbre data is already associated with the corresponding program change (Pch) numbers, correct timbre data can be selected.

The sound generating section 31 generates a musical sound signal based on the configured timbre parameter and the sound generator control parameter. The musical sound signal is sounded from the speaker 25 via the DAC 32.

This sound generating system is mounted on portable information terminals such as cellular phones and is used to reproduce a call signal with melodies and the like. In this case, the portable information terminals originally have the sound generating system except the sound generating apparatus 24. When a call is terminated, for example, the CPU 21 transfers a musical file from the ROM 22 or the RAM 23 to the sound generating apparatus 24. The sound generating system 14 in FIG. 2 is also configured as shown in FIG. 5.

The sound generator 25 may be implemented by software or special hardware. The sound generating system may be FM or PCM. However, it is desirable to be able to reproduce existing musical piece formats such as SMF and SMAF.

Figure 6:
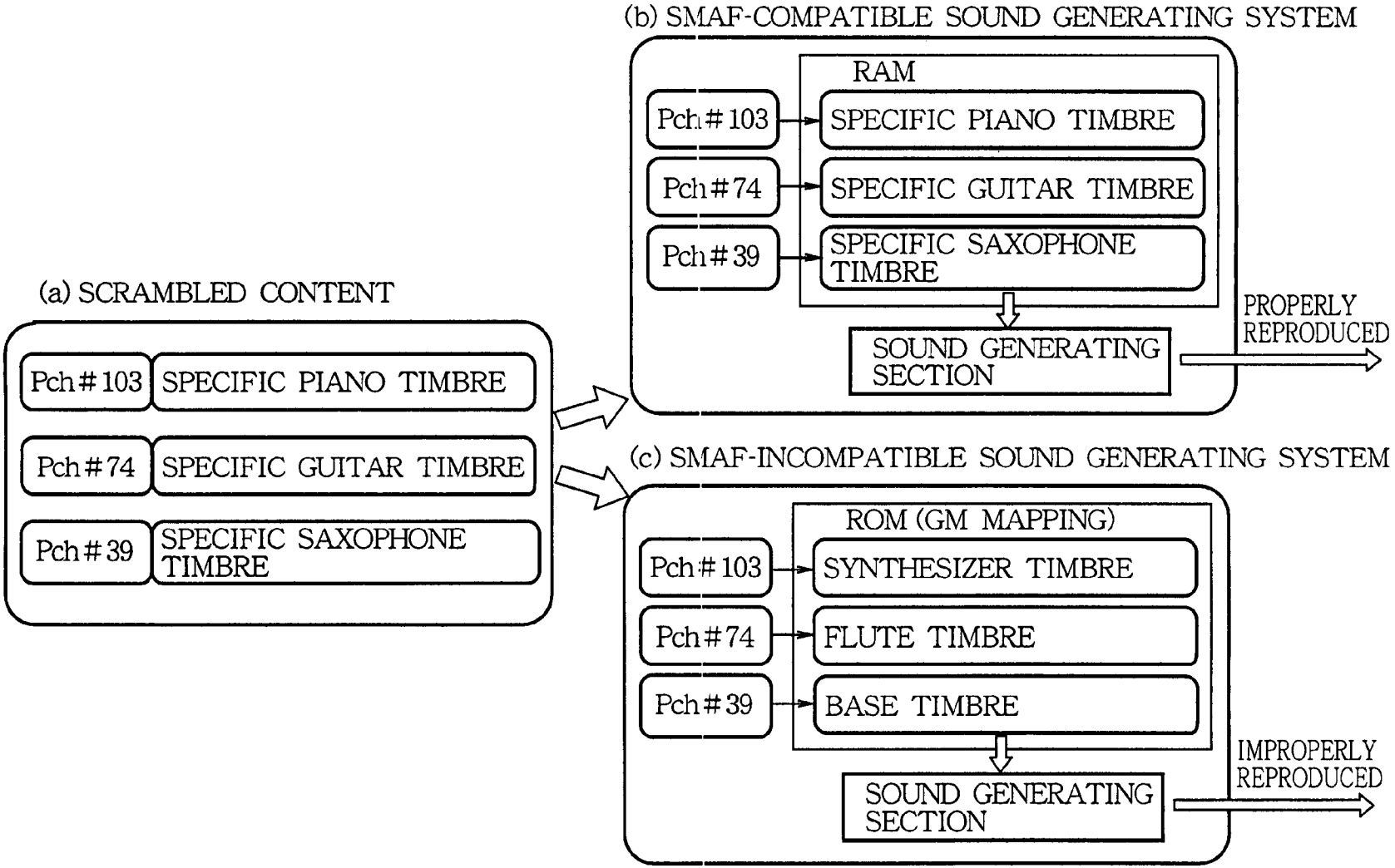
FIG. 6 is a diagram showing reproduction of a musical file having the data interchange format according to the embodiment as shown in FIG. 4.

In FIG. 6, there is a musical file (scramble content (a)) having the data interchange format according to the present invention with the scrambled program change numbers as shown in FIG. 4. FIG. 6 illustrates a case of reproducing the scramble content (a) on an SMAF-incompatible ordinary sound generating system (b) as shown in FIG. 8 and a case of reproducing the scramble content (a) on the SMAF-compatible ordinary sound generating system (c) as shown in FIG. 5.

As shown in FIG. 6, let us consider that the SMAF-compatible sound generating system (b) as shown in FIG. 5 reproduces the scramble content (a) like that shown in FIG. 4. In this case, as mentioned above, the timbre RAM stores the timbre data contained in the scramble content. When receiving a program change associated with the timbre data, the system loads the corresponding timbre data stored in the timbre RAM into the sound generating section. When receiving a note event, the system sounds the note using the loaded timbre. According to the example in FIG. 6, Pch#103 corresponds to the specific piano timbre, Pch#73 to the specific guitar timbre, and Pch#39 to the specific saxophone timbre. The notes are sounded with the same timbres as in (a). In this manner, it is possible to reproduce the musical piece according to the producer's intention.

Namely, the sound generating apparatus 24 has an input section 27, a storage section 30 and an generating section 31. The input section 27 receives a musical file which contains music sequence data representing a music piece and also contains timbre data representing a set of timbres applicable to sounds of the music piece and identified by program change numbers. The music sequence data is composed of event data and timing data. The event data represents program change events which occur during the course of reproducing the music piece and which contain the program change numbers for specifying the timbres. The program change numbers are previously scrambled. The timing data specifies occurrence timing of each program change event. The storage section 30 stores the timbre data which is contained in the inputted musical file and which represents the set of the timbres in correspondence to the scrambled program change numbers. The generating section 31 generates the sounds of the music piece according to the music sequence data such that the specified timbres are properly applied to the generated sounds from the stored set of the timbres in response to the program change events even though the program change numbers are previously scrambled.

Figure 8:
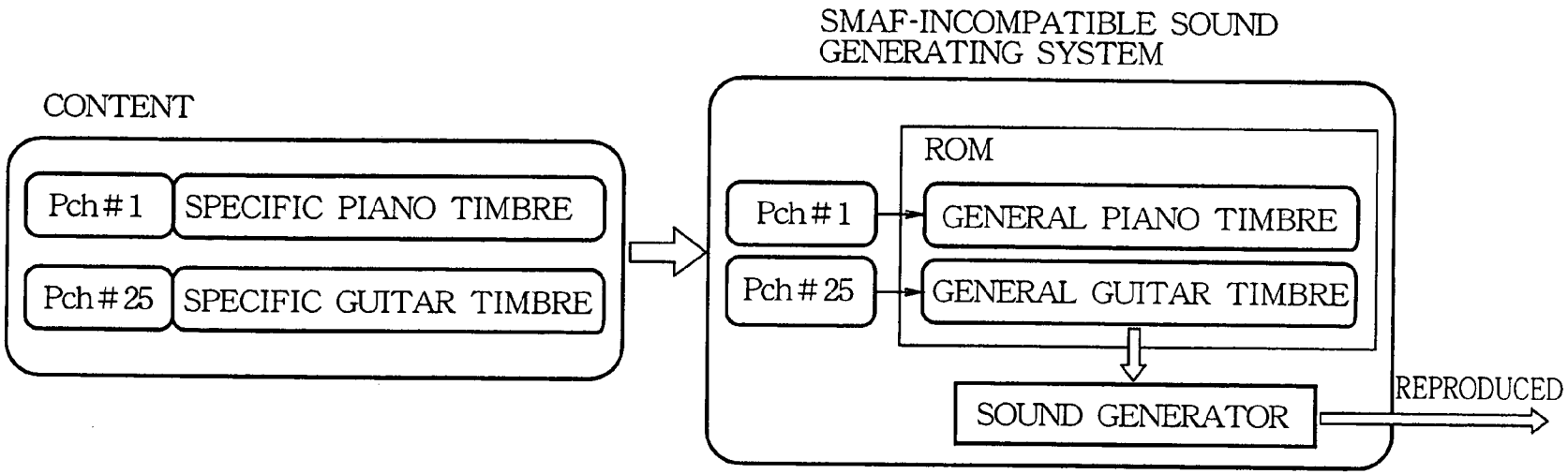
FIG. 8 is a diagram showing a manner by which an ordinary sound generating system reproduces a musical file provided with timbre data.

On the other hand, let us assume that the scramble content (a) is input to the SMAF-incompatible (general) sound generating system as shown in FIG. 8. The timbre data contained in the scramble content is a message incompatible with general sound generating systems and is therefore ignored. When receiving a program change, the system loads the timbre data (with timbres arranged in accordance with the GM standard) into the sound generating section. The timbre data is associated with program change number and is stored in the ROM. When receiving a note event, the system reproduces it using the loaded timbres. According to the example in FIG. 6, Pch#103 corresponds to the synthesizer timbre, Pch#74 to the flute timbre, and Pch#39 to the base timbre. Obviously different timbres are used for reproduction.

The program change numbers differ from the timbres according to the timbre map originally created by the producer. The musical piece is reproduced with timbres the producer did not intend. Accordingly, it is possible to prevent a user from mistakenly underestimating the musical piece.

While the scramble process according to the above-mentioned embodiment randomly reallocates the program change numbers, the present invention is not limited thereto. The following describes a second embodiment of the present invention.

Generally, there are used 16 MIDI channels. The GM standard specifies channel 10 to be used for rhythm performance. The embodiment here aims at scrambling channel numbers in contents.

Figure 7:
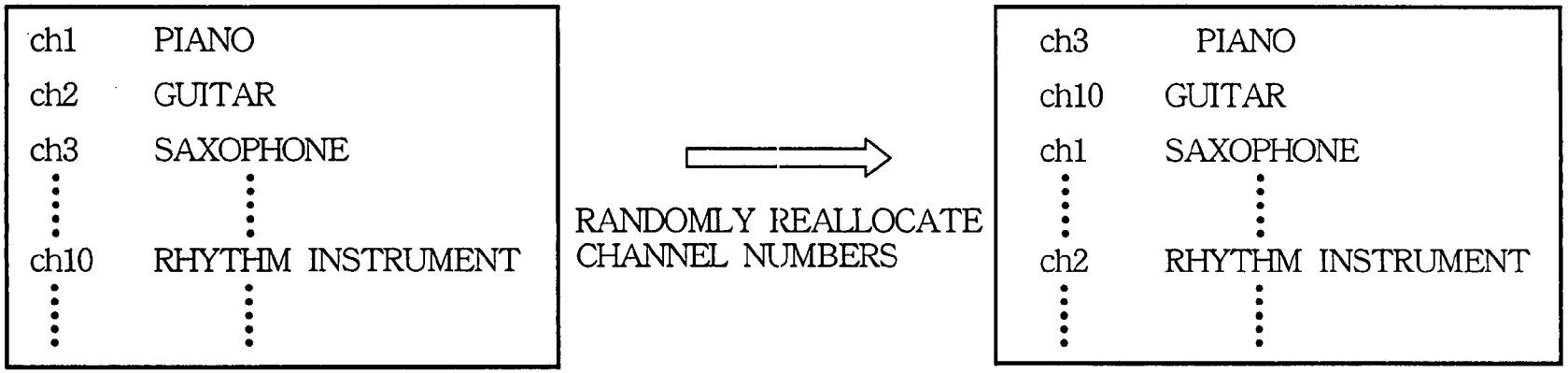
FIG. 7 is a diagram illustrating an example of the scramble process according to another embodiment of the present invention.
Figure 7:
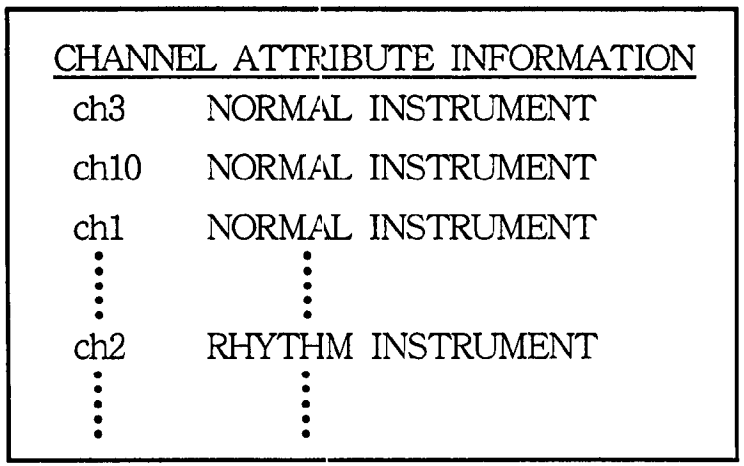

FIG. 7 diagrams the second embodiment of the present invention. FIG. 7(*a*) shows an example of the scramble process according to the embodiment for channel numbers. FIG. 7(*b*) shows channel attribute information (information indicating which channel numbers correspond to channels for normal instruments or rhythm instruments) after performing the scramble process.

According to the example in FIG. 7(*a*), the scramble process is performed to randomly reallocate channel numbers such as channel 1 allocated to piano, channel 2 to guitar, channel 3 to saxophone, . . . , channel 10 to rhythm instrument, and so on. As a result, the channel numbers are changed to allocate channel 3 to piano, channel 10 to guitar, channel 1 to saxophone, . . . , and channel 2 to rhythm instrument. Namely, each channel number of each note event contained in the content is totally changed by the above note scramble process. For example, note events of channel 1 are all changed to note events of channel 3, note events of channel 10 are all changed to note events of channel 2, and so on.

The data interchange format according to the embodiment of the present invention allows the channel attribute information to be defined as an extended event. Sound generating systems compliant with the data interchange format according to the present invention can interpret the extended event.

An authoring tool is used to create musical files having the data interchange format according to the embodiment and randomly reallocate channel numbers in a content between 1 and 16. Reallocation means for this reallocation uses such a reallocation algorithm as not to duplicate channel numbers. The reallocation means stores the reallocated channel attribute information separately in an area other than the sequence data. The reallocation means also stores the scramble information such as the information used for the reallocation algorithm in a specified area such as the Scramble Chunk.

A timbre and an event are defined for each MIDI channel. A program change message determines the timbre. The event indicates musical performance for that channel. This embodiment randomly reallocates the channel numbers and simply changes the channel numbers alone, not to change the correspondence between the timbre and the event for each channel. In the GM standard, the channel 10 is determined to reproduce rhythm instrument sound. Normally, an ordinary sound generator reproduces the sounds of the channel 10 as rhythm instrument sound in compliant to the GM standard. As the result of scrambling process of the channel numbers, the ordinary sound generator treats the original channel 10 as now renumbered channel 2, hence the ordinary sound generator reproduces the sound of original channel 10 as different sound than the rhythm instrument sound. That is, when the content with the scrambled channel numbers is input to an ordinary sound generating system as mentioned above, the extended event as the channel attribute information becomes a message incompatible with the ordinary sound generating system and is therefore ignored. When the note event is received, the content is reproduced with the channel attributes which the ordinary sound generating system maintains by default.

In this case, the channel attributes differ from the original ones explicitly created by the producer. The channels are reproduced with timbres the producer did not intend.

On the other hand, the sound generating system according to the present invention is configured to be able to interpret the scrambled channel attribute information (FIG. 7(*b*)) stored as the extended event. Based on the channel attribute information, the system can normally reproduce the channels by allocating the rhythm instrument timbre to channel 2. When the channel attribute information as the extended event is received, the channel attributes are changed so as to normally interpret the succeeding events. When note events are received, they are reproduced in accordance with the corresponding channel attributes. In this manner, the musical piece can be reproduced according to the producer's intention. Namely, in the sound generating apparatus, an input section receives a musical file which contains music sequence data representing a music piece and also contains channel attribute information which defines correspondence between channel numbers and kinds of timbres allocated to notes of the music piece, the music sequence data comprising event data and timing data, the event data representing note events which determine the notes occurring during the course of reproducing the music piece and which contain the channel numbers specifying the kinds of the timbres allocated to the notes, the channel numbers previously being scrambled, the timing data specifying occurrence timing of each program change event. A setup section sets the correspondence between the scrambled channel numbers and the kind of the timbres based on the channel attribute information contained in the inputted musical file. A generating section generates the notes of the music piece according to the music sequence data contained in the inputted musical file such that the specified kinds of the timbres are properly allocated to the notes in response to the scrambled channel numbers contained in the note events.

Like the first embodiment, the scramble information is unnecessary for reproduction. However, the scramble information can be used to release the scramble. In this manner, this can facilitate works such as editing scrambled contents.

The following describes a third embodiment of the present invention. In MIDI standard, each note event contains each note number. The embodiment randomly reallocates note numbers (equivalent to MIDI key numbers) 0 through 127 for note events in a music content. At this time, reallocation means for the reallocation uses such an algorithm as not to duplicate note numbers. The system stores the scramble information such as information used for the reallocation algorithm separately in a specified area such as the Scramble Chunk other than sequence data in the content. Accordingly, for example, a note event originally specified to sound "do" may be specified to sound "mi". Namely, the data format of the invention contains scramble information which can be interpreted by the compatible sound generating apparatus for restoring the scrambled event data and which cannot be interpreted by the non-compatible sound generating apparatus, whereby the compatible sound generating apparatus can restore the scrambled event data based on the scramble information so as to reproduce the music piece at the first quality, while the non-compatible sound generating apparatus cannot restore the scrambled event data thereby failing to maintain the second quality of the music piece. In detail, the afore-mentioned one type of the musical events are note events which determine notes occurring during the course of reproducing the music piece and which contain note numbers specifying pitches of the notes, and the note numbers are scrambled so that the non-compatible sound generating apparatus cannot reproduce the notes of the music piece at the specified pitches, thereby failing to maintain the second quality.

The sound generating system according to the embodiment of the present invention has means that uses the scramble information to unscramble note numbers. Therefore, it is possible to restore the note numbers to the original note numbers based on the scramble information and then perform the reproduction. Namely, the sound generating apparatus has an input section, a restoring section and a generating section. The input section receives a musical file which contains scramble information and music sequence data representing a music piece. The music sequence data comprises event data which represents various types of musical events occurring during the course of reproducing the music piece, and timing data which specifies occurrence timing of each musical event. The event data representing at least one type of the musical events are scrambled. The scramble information is used for restoring the scrambled event data. The restoring section interprets the scramble information contained in the inputted musical file and that restores the scrambled event data according to the interpreted scramble information. The generating section generates sounds of the music piece according to the music sequence data containing the restored event data.

Let us assume that the sound generating system according to the present invention is supplied with a musical file containing the content with scrambled note numbers and the scramble information. The sound generating system decodes or restores all note events in the file into the original note numbers based on the scramble information. The system transmits the note events to the sound generator in accordance with the time information. The sound generator reproduces the musical piece in accordance with the note events. In this case, the note numbers correspond to the original keys (pitches). The musical piece can be reproduced as the producer has intended.

On the other hand, when the musical file having the data interchange format according to the embodiment is input to an ordinary sound generating system, the scramble information contained in the musical piece is ignored. When a note event is received, it is reproduced with the scrambled note number. Consequently, the note number differs from the key (pitch) originally created by the producer and is reproduced with a pitch not intended by the producer.

The following describes a fourth embodiment of the present invention so as to scramble one or more events in a content.

This embodiment of the present invention applies the scramble process to one or more events contained in the sequence data as shown in FIG. 1(*b*). The system processes events by performing logical operations with specified data in units of bytes or simply inverting bits. The scramble process may be applied to not only events, but also timing data (duration). The system stores the scrambled sequence data and the scramble information for unscrambling such as information used for the scramble algorithm separately in a specified area such as the Scramble Chunk other than sequence data.

The sound generating system according to the embodiment of the present invention is configured to be able to use the scramble information and unscramble the sequence data.

Let us assume that the sound generating system according to the embodiment is supplied with a musical file having such data interchange format. The system decodes the scrambled event into the original event based on the scramble information contained in the musical file. The system transmits the events to the sound generator in accordance with the time information. The sound generator reproduces the musical piece in accordance with the events. The musical piece can be reproduced as the producer intended.

On the other hand, when the musical file having the data interchange format is input to an ordinary sound generating system, the scramble information is ignored. The system cannot interpret the scrambled events, causing an error.

In this manner, this embodiment can also reproduce the musical piece according to the producer's intention.

What is claimed is:

1. A machine readable medium for use in a sound generating apparatus, the medium containing music sequence data which represents a music piece and which enables a compatible sound generating apparatus to reproduce the music piece at a first quality while allowing a non-compatible sound generating apparatus to reproduce the music piece at a second quality different from the first quality, wherein the music sequence data comprises:

event data that represents various types of musical events occurring during the course of reproducing the music piece;

timing data that specifies occurrence timing of each musical event, wherein the event data representing at least one type of the musical events is scrambled such as to affect performance of the non-compatible sound generating apparatus without affecting performance of the compatible sound generating apparatus, so that the compatible sound generating apparatus can maintain the first quality of the music piece even when the music piece is reproduced from the music sequence data containing the scrambled event data, while the non-compatible sound generating apparatus cannot maintain the second quality of the music piece when the music piece is reproduced from the music sequence data containing the scrambled event data; and timbre data which represents a set of timbres applicable to sounds of the music piece and identified by program change numbers, wherein said one type of the musical events are program change events which contain the program change numbers for specifying the timbres, and wherein the program change numbers are scrambled such that the non-compatible sound generating apparatus cannot apply equivalent timbres corresponding to the specified timbres by setting the timbre data to the compatible sound generating apparatus in response to the program change events thereby failing to maintain the second quality, while the compatible sound generating apparatus can properly apply the specified timbres in response to the program change events thereby maintaining the first quality.

2. The machine readable medium according to claim 1, further comprising scramble information which can be interpreted by the compatible sound generating apparatus for restoring the scrambled event data and which cannot be interpreted by the non-compatible sound generating apparatus.

3. The machine readable medium according to claim 2, wherein the event data representing two or more types of the musical events are scrambled such as to affect performance of the non-compatible sound generating apparatus.

4. A machine readable medium for use in a sound generating apparatus, the medium containing music sequence data which represents a music piece and which enables a compatible sound generating apparatus to reproduce the music piece at a first quality while allowing a non-compatible sound generating apparatus to reproduce the music piece at a second quality different from the first quality, wherein the music sequence data comprises:

event data that represents various types of musical events occurring during the course of reproducing the music piece;

timing data that specifies occurrence timing of each musical event, wherein the event data representing at least one type of the musical events is scrambled such as to affect performance of the non-compatible sound generating apparatus without affecting performance of the compatible sound generating apparatus, so that the compatible sound generating apparatus can maintain the first quality of the music piece even when the music piece is reproduced from the music sequence data containing the scrambled event data, while the non-compatible sound generating apparatus cannot maintain the second quality of the music piece when the music piece is reproduced from the music sequence data containing the scrambled event data; and channel attribute information which defines correspondence between channel numbers and kinds of timbres allocated to notes of the music piece, wherein said one type of the musical events are note events which determine the notes occurring during the course of reproducing the music piece and which contain the channel numbers specifying the kinds of the timbres allocated to the notes, and wherein the channel numbers are scrambled such that the non-compatible sound generating apparatus cannot allocate the specified kinds of the timbres to the notes in response to the note events thereby failing to maintain the second quality, while the compatible sound generating apparatus can allocate the specified kinds of the timbres to the notes properly based on the channel attribute information in response to the note events thereby maintaining the first quality.

5. A sound generating apparatus comprising:

an input section that receives a musical file which contains music sequence data representing a music piece and also contains timbre data representing a set of timbres applicable to sounds of the music piece and identified by program change numbers, the music sequence data comprising event data and timing data, the event data representing program change events which occur during the course of reproducing the music piece and which contain the program change numbers for specifying the timbres, the program change numbers being previously scrambled, the timing data specifying occurrence timing of each program change event;

a storage section that stores the timbre data which is contained in the inputted musical file and which represents the set of the timbres in correspondence to the scrambled program change numbers; and a generating section that generates the sounds of the music piece according to the music sequence data such that the specified timbres are properly applied to the generated sounds from the stored set of the timbres by setting the timbre data to the generating section in response to the program change events even though the program change numbers are previously scrambled.

6. A sound generating apparatus comprising:

an input section that receives a musical file which contains music sequence data representing a music piece and also contains channel attribute information which defines correspondence between channel numbers and kinds of timbres allocated to notes of the music piece, the music sequence data comprising event data and timing data, the event data representing note events which determine the notes occurring during the course of reproducing the music piece and which contain the channel numbers specifying the kinds of the timbres allocated to the notes, the channel numbers previously being scrambled, the timing data specifying occurrence timing of each program change event;

a setup section that sets the correspondence between the scrambled channel numbers and the kind of the timbres based on the channel attribute information contained in the inputted musical file; and a generating section that generates the notes of the music piece according to the music sequence data contained in the inputted musical file such that the specified kinds of the timbres are properly allocated to the notes in response to the scrambled channel numbers contained in the note events.

7. A sound generating apparatus comprising:

an input section that receives a musical file which contains scramble information and music sequence data representing a music piece, the music sequence data comprising event data which represents various types of musical events occurring during the course of reproducing the music piece, and timing data which specifies occurrence timing of each musical event, the event data which represents at least one type of the musical events being scrambled, the scramble information being used for restoring the scrambled event data;

a restoring section that interprets the scramble information contained in the inputted musical file and that restores the scrambled event data according to the interpreted scramble information; and a generating section that generates sounds of the music piece according to the music sequence data containing the restored event data, wherein said one type of the musical events are note events which determine notes occurring during the course of reproducing the music piece and which contain channel numbers specifying kinds of timbres allocated to the notes, so that the event data representing the channel numbers are scrambled.

8. An apparatus for creating a musical file, comprising:

an input section that provides music sequence data representing a music piece and having a data format which enables a compatible sound generating apparatus to reproduce the music piece at a first quality while allowing a non-compatible sound generating apparatus to reproduce the music piece at a second quality different from the first quality, the music sequence data comprising event data which represents various types of musical events occurring during the course of reproducing the music piece, and timing data which specifies occurrence timing of each musical event;

a scrambling section that scrambles the event data representing at least one type of the musical events such as to affect performance of the non-compatible sound generating apparatus without affecting performance of the compatible sound generating apparatus; and an output section that outputs a musical file of the music sequence data containing the scrambled event data, so that the compatible sound generating apparatus can maintain the first quality of the music piece even when the music piece is reproduced from the outputted musical file, while the non-compatible sound generating apparatus cannot maintain the second quality of the music piece when the music piece is reproduced from the outputted musical file, wherein the scrambling section scrambles the event data representing said one type of the musical events which are note events determining notes occurring during the course of reproducing the music piece and containing channel numbers specifying kinds of timbres allocated to the notes, and wherein the output section outputs the musical file containing channel attribute information which defines correspondence between the channel numbers and the kinds of the timbres allocated to the notes of the music piece, such that the non-compatible sound generating apparatus cannot allocate the specified kinds of the timbres in response to the note events thereby failing to maintain the second quality, while the compatible sound generating apparatus can allocate the specified kinds of the timbres to the notes properly based on the channel attribute information contained in the musical file thereby maintaining the first quality.

9. An apparatus for creating a musical file, comprising:

an input section that provides music sequence data representing a music piece and having a data format which enable a compatible sound generating apparatus to reproduce the music piece at a first quality while allowing a non-compatible sound generating apparatus to reproduce the music piece at a second quality different from the first quality, the music sequence data comprising event data which represents various types of musical events occurring during the course of reproducing the music piece, and timing data specifies occurrence timing of each musical event;

a scrambling section that scrambles the event data representing at least one type of the musical events such as to affect performance of the non-compatible sound generating apparatus without affecting performance of the compatible sound generating apparatus; and an output section that outputs a musical file of the music sequence data containing the scrambled event data, so that the compatible sound generating apparatus can maintain the first quality of the music piece even when the music piece is reproduced from the outputted musical file, while the non-compatible sound generating apparatus cannot maintain the second quality of the music piece when the music piece is reproduced from the outputted musical file, wherein the scrambling section scrambles the event data representing said one type of the musical events which are program change events containing program change numbers for specifying timbres applicable to sounds of the music piece, and wherein the output section outputs the musical file containing timbre data which represents the timbres specified by the program change numbers, such that the non-compatible sound generating apparatus cannot apply equivalent timbres corresponding to the specified timbres in response to the program change events thereby failing to maintain the second quality, while the compatible sound generating apparatus can properly apply the specified timbres contained in the musical file by setting the timbre data to the compatible sound generating apparatus in response to the program change events thereby maintaining the first quality.

10. A machine readable medium comprising a computer program for use in creating a musical file, the computer program being executable by a computer and configured to cause the computer to:

provide music sequence data representing a music piece and having a data format which enables a compatible sound generating apparatus to reproduce the music piece at a first quality while allowing a non-compatible sound generating apparatus to reproduce the music piece at a second quality different from the first quality, the music sequence data comprising event data which represents various types of musical events occurring during the course of reproducing the music piece, and timing data which specifies occurrence timing of each musical event;

scramble the event data representing at least one type of the musical events such as to affect performance of the non-compatible sound generating apparatus without affecting performance of the compatible sound generating apparatus; and creating a musical file of the music sequence data containing the scrambled event data, so that the compatible sound generating apparatus can maintain the first quality of the music piece even when the music piece is reproduced from the created musical file, while the non-compatible sound generating apparatus cannot maintain the second quality of the music piece when the music piece is reproduced from the created musical file, wherein scrambling the event data scrambles the event data representing said one type of the musical events which are not events determining notes occurring during the course of reproducing the music piece and containing channel numbers specifying kinds of timbres allocated to the notes, and wherein creating the musical file creates a musical file containing channel attribute information which defines correspondence between the channel numbers and the kinds of the timbres allocated to the notes of the music piece, such that the non-compatible sound generating apparatus cannot allocate the specified kinds of the timbres in response to the note events thereby failing to maintain the second quality, while the compatible sound generating apparatus can allocate the specified kinds of the timbres to the notes properly based on the channel attribute information contained in the musical file thereby maintaining the first quality.

* * * * *